US005645714A

United States Patent [19]

Strand et al.

[11] Patent Number: 5,645,714

[45] Date of Patent: Jul. 8, 1997

[54] OIL SAND EXTRACTION PROCESS

[75] Inventors: William L. Strand, Edmonton; Anthony F. Banks, Saskatoon, both of Canada

[73] Assignee: Bitman Resources Inc., Calgary, Canada

[21] Appl. No.: 434,065

[22] Filed: May 3, 1995

[30] Foreign Application Priority Data

May 6, 1994 [CA] Canada ..... 2123076

[51] Int. Cl.[6] ..... C10G 1/04

[52] U.S. Cl. ..... 208/391; 208/390

[58] Field of Search ..... 208/390, 391

[56] References Cited

U.S. PATENT DOCUMENTS

| | | | |
|---|---|---|---|
| 3,594,306 | 7/1971 | Dobson | 208/11 |
| 3,869,384 | 3/1975 | Schutte | 208/391 |
| 3,893,907 | 7/1975 | Canevari | 208/391 |
| 3,904,520 | 9/1975 | Dancy | 23/298 |
| 4,160,718 | 7/1979 | Rendall | 208/11 |
| 4,172,025 | 10/1979 | Porteous et al. | 208/11 |
| 4,225,433 | 9/1980 | Liu et al. | 210/702 |
| 4,236,995 | 12/1980 | Kruyer | 208/391 |
| 4,240,897 | 12/1980 | Clarke | 208/11 |
| 4,250,016 | 2/1981 | Estes et al. | 208/11 |
| 4,324,652 | 4/1982 | Hack | 208/391 |
| 4,330,409 | 5/1982 | Yong et al. | 210/731 |
| 4,331,532 | 5/1982 | Bose | 208/391 |
| 4,406,788 | 9/1983 | Meadus et al. | 210/512.1 |
| 4,414,117 | 11/1983 | Yong et al. | 210/710 |
| 4,425,227 | 1/1984 | Smith | 208/391 |
| 4,456,532 | 6/1984 | Seitzer | 208/391 |
| 4,459,200 | 7/1984 | Dente et al. | 208/11 |
| 4,470,899 | 9/1984 | Miller et al. | 208/11 |
| 4,512,956 | 4/1985 | Robinson et al. | 422/270 |
| 4,533,459 | 8/1985 | Dente et al. | 208/11 |
| 4,561,965 | 12/1985 | Minkkinen | 208/391 |
| 4,648,946 | 3/1987 | Leto et al. | 208/391 |
| 4,678,558 | 7/1987 | Belluteau et al. | 208/390 |
| 4,702,487 | 10/1987 | Stoian et al. | 208/390 |
| 4,828,688 | 5/1989 | Corti et al. | 208/391 |
| 4,946,597 | 8/1990 | Sury | 210/705 |
| 5,290,433 | 3/1994 | Chan | 208/391 |

FOREIGN PATENT DOCUMENTS

| | | | |
|---|---|---|---|
| 645043 | 7/1962 | Canada | 196/11 |
| 793288 | 8/1968 | Canada | 196/11 |
| 793812 | 9/1968 | Canada | 196/11 |
| 892547 | 2/1972 | Canada | 196/11 |
| 1021709 | 11/1977 | Canada | 196/20 |
| 1085761 | 9/1980 | Canada | 196/17 |
| 1165712 | 4/1984 | Canada | 196/23 |
| 1167238 | 5/1984 | Canada | 23/415 |
| 2015784 | 10/1991 | Canada | 196/17 |
| 2030934 | 5/1992 | Canada | 196/17 |
| 360977 | 10/1922 | Germany . | |
| 2611251 | 10/1976 | Germany . | |
| 3815309 | 11/1988 | Germany . | |
| WO92/09672 | 6/1992 | WIPO . | |

OTHER PUBLICATIONS

"Prediction of Viable Tailings Disposal Methods, Proceedings of a Symposium: Sedimentation Consolidation Models", Scott, J.D., and Cymerman, G.J., ASCE Oct. 1984, San Francisco, California.

"Principles of Flocculation, Dispersion, and Selective Flocculation", P. Somasundaran, Proceedings of the International Symposium on Fine Particles Processing, Las Vegas, Nevada, Feb. 24–28, 1980, AIME Publication.

Kemmer, Frank N., The NALCO Water Handbook, McGraw–Hill Book Company (1979), pp. 4–7 to 4–10.

"Strength Development In Oil Sands Sludge/Clay Shale Mixes For Tailings Disposal", Dusseault, M. and Ash, P., UF/FIPR Symposium on Consolidation and Disposal of Phosphatic and Waste Clays, Lakeland, Florida, May 14–15, 1987.

"The Oslo Commercial Extraction Process—An Evolutionary Extension of Current Practice", Stevens, G.S., Rendall, E.O. and Livingstone, W.R., CIM/AOSTRA 1991 Technical Conference, Banff, Alberta, Apr. 21–24, 1991.

PCT/CA91/00415 International Preliminary Examination Report Sheets 1 and 2 referring to the three German references listed above under Foreign Patent Documents. 11 Jun. 1992.

"Athabasca Mineable Oil Sands: The RTR/Gulf Extraction Process—Theroretical Model Bitumen Detachment", A. Corti and M. Dente, Paper No. 81, Fourth UNITAR/UNDP Conference on Heavy Crude and Tar Sands. 1979.

"RTR—Gulf Oil Sands Extraction—Process Evaluation, 1982".

"An Integrated Approach to Environmentally Acceptable Disposal of Athabasca Oilsand Fine Tailings", Sheeran, D., Sethi, A. and Smith, P. Joint CSCE–ASCE National Conference on Environmental Engineering, Jul. 12–14, 1993, Queen Elizabeth Hotel, Montreal, Quebec.

*Primary Examiner*—Helane Myers
*Attorney, Agent, or Firm*—Rodman & Rodman

[57] ABSTRACT

A method for processing lumps of oil sand containing bitumen to produce a bitumen froth and non segregating tailings of a solid material and a sludge. The method includes depositing the lumps of oil sand into a bath of warm water. The lumps are then conditioned by gently contacting them with the warm water to liberate and separate bitumen from the oil sand while minimizing the dispersal into the bath of fine material contained in the oil sand. Following conditioning, the solid material remaining after the liberation and separation of the bitumen from the oil sand is removed from the bath and collected for further processing. The warm water containing bitumen and dispersed fine material is also removed from the bath and collected for further processing. Following removal from the bath, the warm water containing bitumen and dispersed fine material is separated into the bitumen froth and a suspension of dispersed fine material. The suspension of dispersed fine material is dewatered to produce the sludge, which is combined with the solid material to produce the tailings.

39 Claims, 3 Drawing Sheets

OIL SAND EXTRACTION PROCESS

TECHNICAL FIELD

This invention relates to a method for processing oil sand containing bitumen to produce a bitumen froth and nonsegregating tailings of solid material and sludge.

BACKGROUND ART

Oil sand is essentially a matrix of bitumen, mineral material and water, although encapsulated air may also be present. The bitumen component of oil sand consists of viscous hydrocarbons which behave much like a solid at normal in situ temperatures and which act as a binder for the other components of the oil sand matrix. The mineral matter component of oil sand typically consists largely of sand, but may also include rock, silt and clay. Sand and rock are considered to be coarse mineral matter, while clay and silt are considered to be fine mineral matter, where fines are defined as mineral matter having a particular size of less than 44 microns. The water component of oil sand consists essentially of a film of connate water surrounding the sand in the oil sand matrix, and may also contain particles of fine mineral matter within it.

A typical deposit of oil sand will contain about 10% to 12% bitumen and about 3% to 6% water, with the remainder of the oil sand being made up of mineral matter. Typically the mineral matter component in oil sand will contain about 14% to 20% fines, measured by weight of total mineral matter contained in the deposit, but the amount of fines may increase to about 30% or more for poorer quality deposits. Oil sand extracted from the Athabasca area near Fort McMurray, Alberta, Canada, averages about 11% bitumen, 5% water and 84% mineral matter, with about 15% to 20% of the mineral matter being made up of fines.

Oil sand deposits are mined for the purpose of extracting bitumen from them, which is then upgraded to synthetic crude oil. Currently, the most widely used process for extracting bitumen from oil sand is the "hot water process", in which both aggressive thermal action and aggressive mechanical action are used to liberate and separate bitumen from the oil sand. The hot water process is a three step process. First, the oil sand is conditioned by mixing it with hot water at about 95° Celsius and steam in a conditioning vessel which vigorously agitates the resulting slurry in order to completely disintegrate the oil sand. Second, once the disintegration is complete, the slurry is separated by allowing the sand and rock to settle out, and the bitumen, having air entrained within it, floats to the top of the slurry and is withdrawn as a bitumen froth. Third, the remainder of the slurry, which is referred to as the middlings, is then treated further or scavenged by froth flotation techniques to recover bitumen that did not float to the top of the slurry during the separation step.

The goal in the hot water process is to recover as much of the bitumen as possible before scavenging the middlings, since the middlings include most of the fines that were contained in the oil sand, but in a dispersed state, which tends to hold them and the remaining bitumen in suspension, thus making the recovery of the bitumen during the scavenging step quite difficult.

To assist in the recovery of bitumen during the separation step, sodium hydroxide (caustic) is typically added to the slurry during the conditioning step in order to maintain the pH of the slurry slightly basic, in the range of 8.0 to 8.5. This has the effect of chemically dispersing the clay that becomes dispersed in the slurry during the conditioning step, which in turn reduces the viscosity of the slurry by reducing the particle size of the clay minerals present in the slurry. With the clay present in the slurry chemically dispersed and the viscosity of the slurry lowered, the bitumen more readily floats to the surface of the slurry and can therefore be more readily recovered during the separation step.

There are several disadvantages to the hot water process. The use of hot water and steam in the process, as well as the vigorous agitation to which the oil sand is subjected during the conditioning step, mean that the energy requirements of the process are very high. In addition, since the main goal of the hot water process is to liberate and separate bitumen from the oil sand by completely destroying the oil sand matrix, most of the fine mineral matter contained in the oil sand becomes mechanically dispersed throughout the slurry during the conditioning step.

The addition of caustic to the slurry to reduce the viscosity of the slurry results in further chemical dispersal of the clay in the fine mineral matter, whereby the size of the individual clay particles may be reduced to as small as 0.2 microns. The combination of the vigorous and complete physical dispersal of the fines contained in the oil sand and the chemical dispersal of the clay in the resulting slurry create a middlings stream that may contain a large amount of very well dispersed fines held in suspension, particularly where the oil sand deposit is of lower quality and therefore has a relatively high fines content. As the fines content of the oil sand feedstock increases, the concentration of fines in the slurry increases, and recovery of bitumen from the slurry becomes more difficult, since the suspended fine particles tend to "trap" bitumen within the slurry.

In addition to the problems regarding the recovery of bitumen from slurries containing a large amount of dispersed fines, the middlings stream that remains following the scavenging step poses a huge disposal problem, since it constitutes a sludge that tends to settle and consolidate very slowly. Current practice for the disposal of the sludge remaining after the scavenging step involves pumping it into huge tailing ponds, where the fines slowly settle and stratify. After several weeks, some of the water forming the sludge will be present at the top of the tailing pond containing only a small amount of suspended fines. This water may be recycled for use in the hot water process, after being reheated to the process temperature. The remaining sludge continues to settle and gradually increases in density until over a period of perhaps 10 years, the solids concentration of the sludge may increase to up to 50%. Complete settlement and consolidation of the sludge may take in the order of hundreds of years. It is thought that the reason for the slow consolidation of the sludge is that the clays that become physically and chemically dispersed during the hot water process partially reflocculate into a fragile gel network, through which fines that are larger than the clay particles gradually settle.

In any event, because of the characteristics of the middlings sludge, the tailing ponds cannot be completely rehabilitated for many, many years, and only a portion of the water that enters the tailing ponds can be recovered and reused in the hot water process, thus creating a requirement that a large amount of makeup water be available for the hot water process to make up for the water that is lost to the tailing ponds.

Some attempts have been made to improve upon the hot water process. Canadian Patent No. 1,085,761 (Rendall) issued on Sep. 16, 1980 discloses a process for extracting bitumen from oil sand that entails showering the oil sand through a bath of hot water while passing the oil sand and hot water through the conditioning vessel countercurrent to each other. To assist in the separation of bitumen from the resulting slurry, the addition of caustic or a polyphosphate as a froth suppressing agent is taught. It is claimed that this invention reduces the amount of process water required from the amount used in the typical hot water process, thus reducing the energy requirements of the process. However, this patent does not address the effects of physical dispersal of fine material by agitation of the oil sand, or chemical dispersal of clay by the addition of caustic to the slurry. It also does not address the high energy requirements necessitated by the vigorous agitation of the oil sand and the use of a high process temperature.

U.S. Pat. No. 4,512,956 (Robinson et al), issued on Apr. 23, 1985, and U.S. Pat. No. 4,533,459 (Dente et al), issued on Aug. 6, 1985, disclose respectively, an apparatus for extracting bitumen from oil sand, and a process utilizing the apparatus. These patents recognize the desirability of minimizing the physical dispersal of fines during the extraction process and offer as a solution the conditioning of oil sand with a large amount of hot process water, while at the same time minimizing the mechanical action during the conditioning step so that the oil sand is not substantially disintegrated. A combination of the high ratio of water to oil sand in the slurry, the gentleness of the conditioning step, and the addition of caustic to regulate the pH of the slurry is stated to improve the recovery of bitumen from the oil sand, as well as reduce the energy requirements as compared with the hot water process, since more process water can be recycled and less energy is expended in gently conditioning the oil sand. However, the process disclosed by these patents still makes use of hot water, and at the high ratios of water to oil sand prescribed by the patents, the thermal energy requirements are very significant. Furthermore, because caustic or another reagent is added in order to adjust upwards the pH of the slurry, the effects of chemical dispersal of the clays in the slurry will make the resulting middlings sludge difficult to dispose of, even if the relative amount of fines in the slurry is reduced as compared with the hot water process.

Canadian Patent Application No. 2,030,934 (Strand), filed on Nov. 27, 1990, and corresponding Patent Cooperation Treaty Patent Application No. PCT/CA91/00415, filed on Nov. 22, 1991, both describe an extraction apparatus and process employing a countercurrent separator vessel in which oil sand is gently rolled from one end to the other by a spiral ribbon and mixer elements while hot water, defined as having a temperature of 50° Celsius circulates in the opposite direction. Two streams are then removed from opposite ends of the separator vessel. One stream contains coarse material and some water, while the other stream contains bitumen and dispersed fines in a slurry. Mechanical action is minimized and liberation and separation of bitumen is accomplished almost entirely by thermal action. It is stated in these applications that an important objective of the invention is to leave most of the clay in the oil sand in its original state so that it may be returned along with separated coarse material, to the site from which the oil sand was mined. It is also stated that due to limited dispersal of clay in the process water, it should not normally be necessary to add caustic to aid in the recovery of bitumen, and a substantial portion of the process water will be available for recycling. As for the amount of process water required, it is stated that the water to oil sand ratio is a function of the heat transfer requirements of the system, and not the requirement to provide adequate dilution of the slurry to facilitate bitumen recovery.

Other attempts have been made to improve upon current practises for disposing of and rehabilitating the solid material and sludge that is generated during the hot water process. U.S. Pat. No. 4,414,117 (Yong et al), issued on Nov. 8, 1983, relates to the discovery that clay sludge will settle more quickly if carbonate and bicarbonate ions are first removed from the sludge. The patent teaches that the removal of carbonate and bicarbonate ions can be accomplished in several ways, such as by the use of an ion exchange resin, the addition of an ion precipitant, or the use of a mineral acid such as hydrochloric acid to convert the carbonate and bicarbonate ions to $CO_2$. It is stated that best results are obtained when essentially all of the carbonate and bicarbonate ions are removed from the system with the result being that the settlement rate of the sludge is significantly accelerated.

Similarly, it has been observed that the microstructure of fine oil sand tailings is the subject of a reversible process and it has been postulated that the microstructure can be controlled by controlling both the pH and bicarbonate ion concentration in the tailings (Sheeran, D., Sethi, A., and Smith, P., An Integrated Approach to Environmentally Acceptable Disposal of Athabasca Oilsand Fine Tailings, Joint CSCE-ASCE National Conference on Environmental Engineering, Jul. 12–14, 1993, Queen Elizabeth Hotel, Montreal, Quebec).

U.S. Pat. No. 4,225,433 (Liu et al) relates to a process whereby the solid material and the sludge that is generated during the hot water process is combined together, mixed with a flocculating agent and then vacuum filtered to separate water and solid material. The patent indicates that the fines form agglomerates with the coarse particles and that the agglomerates settle at a rate comparable to that of the solid material alone.

Other efforts have focused on the characteristics of the solid tailings and sludge tailings as a whole, and in particular, the feasibility of combining them together to create a waste stream that is easier to handle. (Scott, J. D., and Cymerman, G. J., Prediction of Viable Tailings Disposal Methods, Proceedings of a Symposium: Sedimentation Consolidation Models, ASCE/October, 1984, San Francisco, Calif.). This paper indicates that tailings typically produced by Syncrude Canada Ltd. at Fort McMurray, Alberta tend to be a segregating mix so that the solid material settles out from the tailings quickly, leaving the sludge. Segregation is detrimental due to the problems associated with the disposal of the sludge. To prevent fines segregation, it is stated that it is necessary to lower the water content of the tailings stream, increase the fines content of the tailings, or do both. Based upon this analysis, the authors conclude that promising proposals include the mixing of mature sludge taken from the bottom of tailing ponds with a thickened sand tailing to produce a nonsegregating mix, or the mixing of sand, sludge and overburden stripped from the mine site in order to produce a nonsegregating mix.

It can therefore be seen that the challenge in extracting bitumen from oil sand is to maximize the recovery of bitumen while minimizing the amount of sludge that is generated, and while controlling the physical characteristics of the sludge so that it may be more easily disposed of. Also desirable is to minimize the energy requirements of the process as much as possible so that the process can be carried out in an economical and environmentally acceptable manner.

More specifically, the goal is to eliminate the need for sludge tailing ponds which typically occupy many square kilometres, and replace the sludge currently disposed of in these tailing ponds with nonsegregating tailings produced from both the solid material generated by the extraction process and the sludge generated by the extraction process. In order to minimize the energy requirements of the process, it is necessary both to limit the thermal and mechanical energy input into the process and to limit the amount of thermal energy that is lost during the process to the various product and waste streams.

DISCLOSURE OF INVENTION

The present invention relates to an overall method for processing lumps of oil sand containing bitumen to produce bitumen froth and nonsegregating tailings of a solid material and a sludge. The method comprises the following basic steps:

(a) depositing the lumps into a bath of warm water;

(b) conditioning the lumps by gently contacting them with the warm water to liberate and separate bitumen from the oil sand while minimizing the dispersal into the bath of fine material contained in the oil sand;

(c) removing from the bath and collecting for further processing the solid material remaining after the liberation and separation of the bitumen from the oil sand;

(d) removing from the bath and collecting for further processing the warm water containing bitumen and dispersed fine material;

(e) separating the warm water containing bitumen and dispersed fine material into the bitumen froth and a suspension of dispersed fine material;

(f) dewatering the suspension of dispersed fine material to produce the sludge; and, (g) combining the solid material and the sludge to produce the tailings.

The lumps of oil sand should be of a size that will not jam process machinery. The conditioning step should minimize the agitation of the lumps and provide adequate contact between the lumps and the warm water so that the heat from the warm water can be transferred to the lumps. Preferably, the lumps are gently rolled in the bath, preferably by containing the bath in a cylindrical drum and then gently rolling the lumps through the drum by a spiral ribbon and lifters associated with the drum. To maximize the heat transfer to the lumps and minimize their agitation, the lumps are preferably maintained beneath the surface of the bath while being conditioned.

The ratio by weight of warm water to oil sand in the bath is a function of the amount of heat required to be transferred to the oil sand and the amount of fine material contained in the oil sand, but is preferably in the range of between 0.65 to 1.10. The ratio should also be chosen so that the concentration of dispersed fine material in the warm water following the conditioning step is less than about 15% by weight of the warm water containing bitumen and dispersed fine material, since higher concentrations of dispersed fine material may interfere with bitumen recovery. The amount of heat transferred to the oil sand in the bath is preferably such that the temperature of the warm water following the conditioning step is between about 40° Celsius and 60° Celsius, and optimally about 50° Celsius. In order to achieve the appropriate temperature following the conditioning step, the warm water entering the bath is preferably at a temperature of between about 50° Celsius and 75° Celsius.

To facilitate sufficient heat transfer to the oil sand and sufficient time for liberation and separation of most of the bitumen from the oil sand, the conditioning step is preferably performed for a minimum of 5 minutes, and may continue for up to 60 minutes before clay fines in the oil sand begin to deconsolidate and therefore lose their consolidation strength. Preferably, the maximum length of the conditioning step is about 20 minutes since a longer conditioning step does not significantly increase bitumen recovery and is energy inefficient.

A preferred apparatus for performing the conditioning step is a countercurrent separator having a spiral ribbon and lifters associated with it, wherein the solid material is removed from one end of the separator and the warm water containing bitumen and dispersed fine material is removed from the other end of the separator, and wherein the solid material and the warm water are supplied to the separator at the opposite ends from which they are removed. The separator may include a settling zone at the end from which the warm water is removed to permit solid material in the warm water to settle to the bottom of the separator and then be carried to the opposite end of the separator for removal. The lifters associated with the separator are preferably adjustable, so that the nature and extent of the movement of the lumps within the separator may be altered by adjusting the lifters. This adjustment is preferably made from outside of the separator.

In order to minimize the chemical dispersal of fine material that is dispersed in the warm water, the concentration of bicarbonate ions in the warm water should preferably be maintained at less than about 6 Meq/litre. Since bicarbonate ions tend to form in solution when the pH of the solution is higher than about 7 and will leave the solution when the pH is lower than about 7, the bicarbonate ion concentration in the warm water is preferably controlled by adding an acid to the warm water to reduce its pH.

The separation of the warm water containing bitumen and dispersed fine material into the bitumen froth and a suspension of dispersed fine material may comprise floating the bitumen on the surface of the warm water and then removing the bitumen as bitumen froth. Preferably, the resulting suspension of dispersed fine material is further processed by being subjected to froth flotation to produce a froth containing bitumen and a further suspension of dispersed fine material. The froth containing bitumen is then preferably separated into bitumen and a froth by floating the bitumen on top of the froth, following which the bitumen is removed from the top of the froth and the froth is returned for further froth flotation.

The dewatering of the suspension of dispersed fine material to produce the sludge preferably comprises mixing a flocculant with the suspension to promote the aggregation and settlement of fine material contained in the suspension, and then allowing the fine material to settle to produce the sludge. The dewatering step is performed for preferably less than about 12 hours in order to permit sufficient settlement of the fine material so that the resulting water is clean enough to be available to be reheated and returned to the bath. Optimally, the dewatering step is performed for between about 6 and 12 hours.

The tailings are preferably produced in one of two ways, and preferably are produced using substantially all of the solid material and substantially all of the sludge that is generated from a given quantity of oil sand processed. Regardless of which way the tailings are produced, they exhibit the best engineering properties where the fine material content of the oil sand is less than about 30% by total weight of mineral matter in the oil sand, and preferably, is less than about 25% by total weight of mineral matter in the oil sand. The solid material may be dewatered, preferably by filtering, following which it may be combined with the sludge to produce the nonsegregating tailings, which typically have a moisture content of between about 12% and 20% by total weight of tailings.

Alternatively and preferably, the solid material may be mixed with an effective amount of a flocculant, mixed with the sludge, and the mixture of the solid material, flocculant and sludge may then be dewatered to produce the nonsegregating tailings, which typically have a moisture content of between about 12% and 20% by total weight of tailings. Preferably, the solid material is mixed with the flocculant before being mixed with the sludge, and preferably the mixture is dewatered by filtering. Filtering of either the solid material or the mixture of the solid material, flocculant and sludge preferably comprises spreading them on a moving belt filter and then exposing them to a vacuum to withdraw moisture from them.

The method typically provides for a bitumen recovery of between about 80% and 95% of the total amount of bitumen contained in the oil sand. The lower end of the range is experienced with oil sand that has a high fine material content and a low bitumen content. The higher end of the range is experienced where the oil sand has a low fine material content and a high bitumen content. To increase the efficiency of the overall method, the water that is recovered during the step of dewatering the suspension of dispersed fine material and the step of dewatering either the solid material or the mixture of the solid material, flocculant and sludge may be reheated and returned to the bath. Preferably, the warm water recovered during the step of dewatering either the solid material or the mixture of solid material, flocculant and sludge is added to the warm water containing bitumen and dispersed fine material so that it may undergo froth flotation treatment, and the warm water recovered during the step of dewatering the suspension of dispersed fine material is reheated and returned to the bath.

In a further embodiment of the invention, a method is provided for processing a solid material containing an amount of water and a sludge of dispersed fine material to produce nonsegregating tailings of solid material and sludge. The method of this further embodiment comprises the following steps:

(a) mixing the solid material with an effective amount of a flocculant;

(b) mixing the solid material and the flocculant with the sludge; and, (c) dewatering the mixture of the solid material, flocculant and the sludge to produce the tailings.

Preferably, the solid material is mixed with the flocculant before being mixed with the sludge. In order to promote the aggregation of clay that is part of the fine material, the concentration of bicarbonate ions in the water contained in the solid material and the sludge should preferably be less than about 6 Meq/litre. The bicarbonate ion concentration may be controlled by adding an acid to the solid material and the sludge to reduce their pH.

The nonsegregating tailings produced by the method of the further embodiment preferably have a moisture content of between about 12% and 20% by total weight of tailings. Preferably, the solid material and the sludge are both generated from the processing of oil sand, and preferably the tailings are produced using substantially all of the solid material and substantially all of the sludge that is generated from a given quantity of oil sand. The tailings produced by this further embodiment exhibit the best engineering properties where the combined fine material content of the solid material and the sludge is less than about 30% by total weight of mineral matter and preferably is less than about 25% by total weight of mineral matter.

Preferably, the step of dewatering the mixture of solid material, flocculant and sludge comprises filtering the mixture, and preferably the filtering of the mixture comprises spreading the mixture on a moving belt filter and then exposing the mixture to a vacuum to withdraw moisture from it.

BRIEF DESCRIPTION OF THE DRAWINGS

The invention will now be described with reference to the accompanying drawings, in which.

DESCRIPTION OF THE PREFERRED EMBODIMENT

Figure 1:
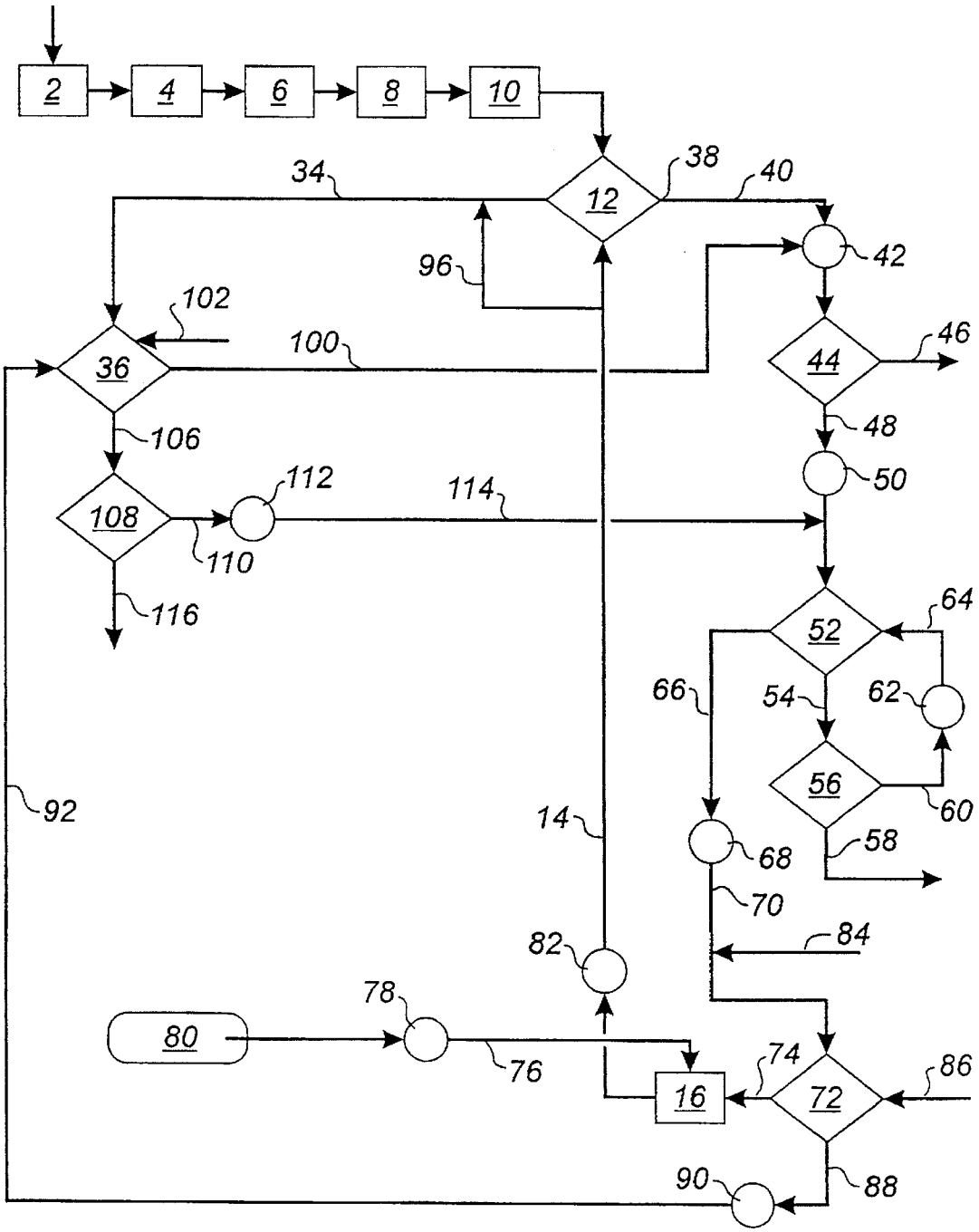
FIG. 1 is a flow chart of the overall method for the processing of oil sand according to this invention.

This invention is a method for processing lumps of oil sand which contain bitumen to produce a bitumen froth as one product stream and nonsegregating tailings as a second product stream. The bitumen froth that is produced will consist mostly of the heavy oil that is commonly known as bitumen, but may also include small amounts of water and fine mineral matter which is not able to be separated from the bitumen during the processing of the oil sand. The bitumen froth that is produced by this invention is therefore later subjected to further cleaning before being upgraded to synthetic crude oil.

The nonsegregating tailings that are produced will be made up of solid material and sludge. The solid material comprises coarse mineral matter, defined as mineral matter having a particle size of greater than 44 microns, as well as non-dispersed fine mineral matter, which behaves much like coarse mineral matter in terms of settlement characteristics. As a result, the solid material will contain rock, sand, and lumps of clay and silt. The sludge comprises a suspension of dispersed fine material, which is dispersed fine mineral matter consisting of clays and silts. A small amount of coarse material may also be present in the sludge, and both the solid material and the sludge may contain small amounts of bitumen which is not able to be separated from the solid material or the sludge during the processing of the oil sand.

The lumps of oil sand that are processed using this method comprise the raw oil sand feedstock that is mined from an oil sand deposit, which lumps are of a size suitable for handling by the process machinery. The lumps are not necessarily homogeneous, and may contain portions of stone, cemented sand and lumps of clay, silt and organic material in addition to oil sand, which consists of a matrix of bitumen, mineral matter and water. Since bitumen acts as the binder in the oil sand matrix, and since the objective of this invention is to recover bitumen from oil sand, it can be seen that some of the lumps will become totally or partially destroyed in the course of processing, and that the solid material that remains afterwards will consist of those lumps that are not held together by bitumen and will also consist of the coarse fractions of the oil sand matrix that remain after the removal of the bitumen.

The method of this invention is suitable for use in processing a wide range of different types of oil sand deposit, and has been tested extensively in the processing of oil sand deposits from the Athabasca area near Fort McMurray, Alberta, Canada. Typically, oil sand deposits from this area average about 11% bitumen by total weight of deposit, 5% water by total weight of deposit, and 84% mineral matter by total weight of deposit. The mineral matter component of Athabasca area oil sand typically contains 15% to 20% fine material, by total weight of mineral matter, and the rest of the mineral matter is made up of coarse material. However, some deposits at Fort McMurray may contain up to 30% or more fine material by weight of total mineral matter in the deposit. Fine material includes all mineral matter that has a particle size of less than 44 microns, regardless of whether the material is present in the oil sand deposit as individual particles or as lumps, aggregations, or flocs.

As a general rule, the higher the fine material content in an oil sand deposit, the more difficult the oil sand is to process for the extraction of bitumen. The reason for this is that it is dispersed fine material that increases the viscosity of the process water into which the bitumen is released, and the higher the amount of dispersed fine material, the higher the viscosity of the process water. This increased viscosity in turn makes it more difficult to separate bitumen from the process water. This increased viscosity and the negative effects thereof can be offset to some degree, as in the present invention, by minimizing the dispersal of fine material during the processing of the oil sand.

Also, as a general rule, the higher the content of the fine material in the oil sand, the more sludge that is generated by the extraction process, and the more difficult the disposal problem for the sludge. Once again, the generation of large amounts of sludge and the negative effects thereof can be minimized by minimizing the dispersal of fine material during the processing of the oil sand.

It has also been found that according to this invention, that as the fine material content of the oil sand feedstock increases, the engineering properties of the resulting tailings become less desirable. For example, the tailings produced have been found to be trafficable upon disposal so long as the fine material content of the oil sand feedstock does not exceed about 25%. When the fine material content of the oil sand feedstock exceeds 25%, the tailings produced tend to be stackable, in the sense that they are suitable for backfilling purposes, but will no longer sustain vehicular traffic. Testing has shown, however, that even when the fine material content of the oil sand feedstock exceeds 25% and approaches 30%, the tailings continue to be nonsegregating.

Nonsegregation of the tailings produced by this method is an important feature of this invention. Nonsegregating tailings are defined as tailings that will retain their homogeneity over time and will therefore not separate into coarse material, sludge and clarified water. It is due in part to the segregating nature of the tailings produced by the hot water process that the huge tailing ponds are necessary in order to dispose of the sludge produced by the process. By creating nonsegregating tailings out of all of the solid material and the sludge that is generated during the processing of oil sand, these tailing ponds may be eliminated.

As a result of the above, the present invention is directed mainly at providing a method for the efficient recovery of bitumen from oil sand while at the same time eliminating the disposal problems associated with the resulting tailings which heretofore have been deposited in large tailing ponds. In accomplishing these objectives, the method also reduces the thermal and mechanical energy inputs to the process and minimizes the thermal energy lost to the various product streams resulting from the process, thus making the method relatively energy efficient.

The preferred embodiment of the present invention is outlined in the flow chart depicted in FIG. 1. The first step in the method is to break the oil sand feedstock to be processed into lumps of a size that will not jam and are therefore compatible with process machinery. This is accomplished by feeding mined oil sand to a conventional feeder breaker (2) or other size limiting device where the oil sand is reduced to lumps of a maximum size of between 20 centimetres and 40 centimetres. The lumps of oil sand are then placed on a conveyor (4) which transports them to a feed bin (6) or stock pile. The lumps of oil sand are fed at a controlled rate continuously from the feed bin (6) to one end of a countercurrent separator (12) via a belt feeder (8) and conveyor line (10).

Warm water is fed at a controlled rate continuously to the opposite end of the separator (12) via a warm water line (14) which in turn is fed by a water heater (16). The water heater (16) comprises a submerged combustion water heater (not shown) which effects heat transfer to the water from the hot combustion gases which are discharged into the water. The submerged combustion water heater is utilized because of its high efficiency heat transfer and its ability to handle water that contains amounts of dispersed fine material. However, other forms of heating apparatus known to those skilled in the art may be used.

The preferred separator (12) is described in PCT Patent Application No. PCT/CA91/00415. For convenience, FIG. 1 and FIG. 2 of that patent application are reproduced as FIG. 2 and FIG. 3, respectively, of this application. However, other forms of separator or digester apparatus may be used, such as for example the digester described in U.S. Pat. No. 4,512,956, provided that such apparatus provides for liberation and separation of bitumen by largely thermal action, rather than by mechanical action, so as to minimize the dispersal of fine material.

Figure 2:
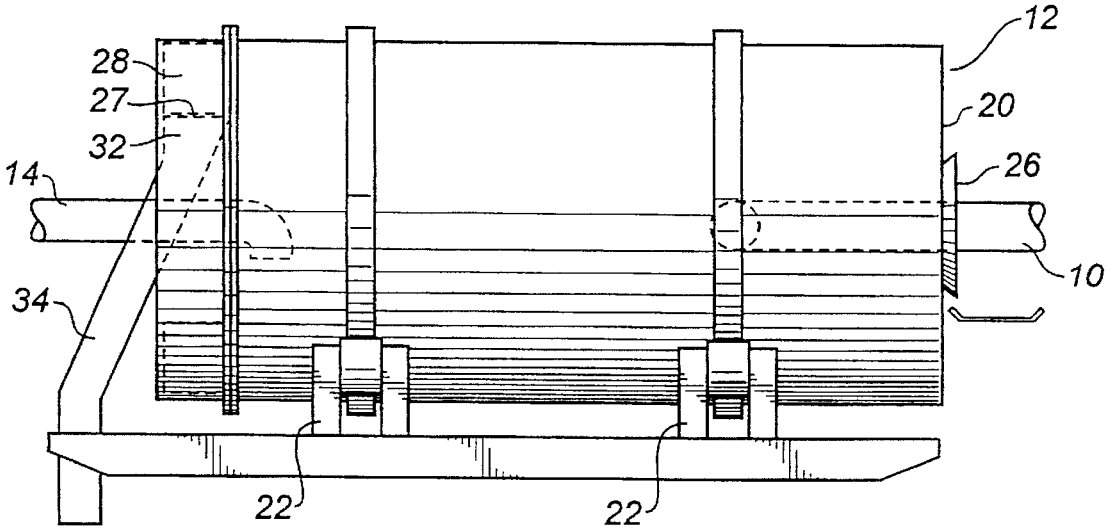
FIG. 2 is a side elevation of the separator vessel which is preferred for use in the conditioning step of this invention.
Figure 3:
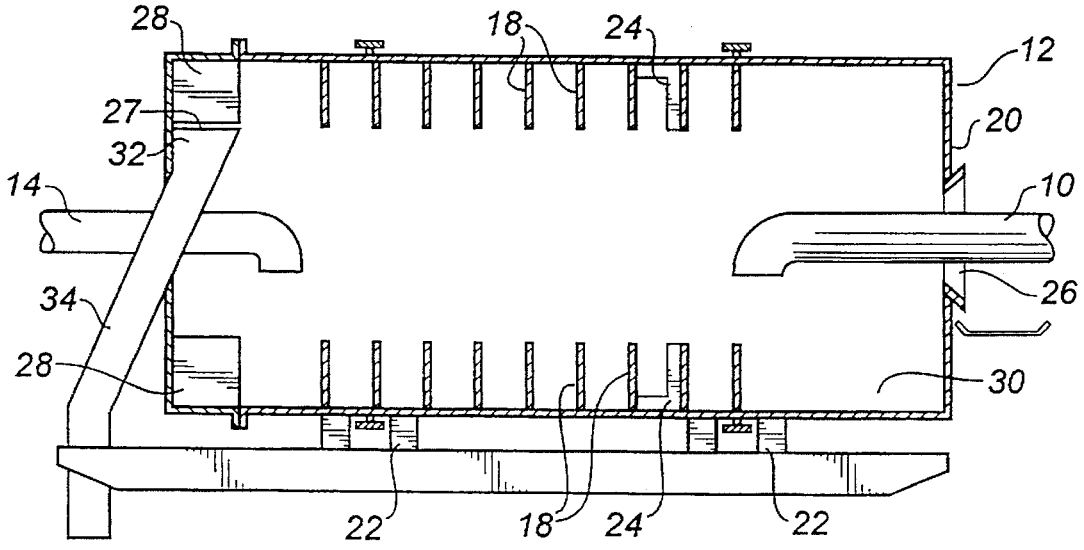
FIG. 3 is a longitudinal section of the separator vessel depicted in FIG. 2.

Referring to FIG. 2 and FIG. 3, the lumps of oil sand are fed to one end of the separator (12) by the conveyor line (10) which extends into the separator (12) at least far enough so that the oil sand can be guided to the start of a spiral ribbon (18) associated with the separator (12). The warm water is fed to the other end of the separator by the warm water line (14). The separator (12) comprises a drum (20) which is mounted on rollers (22) for rotation about a horizontal axis, and which is driven by drive means well known in the art. The spiral ribbon (18) is fixed to the inside of the drum (20) and includes a number of separate flights. Also associated with the drum (20) are a number of lifters (24) which consist of flat blades mounted on the interior of the drum (20) essentially perpendicular to the flights of the spiral ribbon (18). The angles of the lifters (24) are adjustable from outside of the drum (20) in order to adjust the degree of conditioning imparted to the lumps of oil sand.

The separator (12) is equipped with a warm water discharge opening (26) from which warm water containing bitumen and dispersed fine material are withdrawn from the separator (12), which warm water discharge opening (26) is at the opposite end of the separator (12) from the warm water line (14), and also has a solid material discharge opening (27) at the opposite end of the separator (12) from the conveyor line (10), and which is fed by a number of draining pockets (28), which lift the solid material out of the bath to partially drain it before discharging the solid material from the separator (12). Finally, the separator (12) is also equipped with a settling zone (30) adjacent the warm water discharge opening (26) which permits solid material to settle to the bottom of the separator (12) before the warm water exits the separator (12).

The second step of the process is depositing the lumps of oil sand into a bath of warm water, followed by the third step of conditioning the lumps of oil sand by gently contacting them with the warm water. The performance of the conditioning step is dependent upon a number of variables, such as desired degree of conditioning, desired residence time in the separator (12), temperature of the oil sand feedstock and composition of the oil sand feedstock. These variables translate into variability of speed of revolution of the drum (20), the angle of the lifters (24), temperature of the warm water entering the separator (12), and the ratio by weight of water to oil sand which is fed to the separator (12), all of which are in turn dependent upon the sizing of the separator (12) and the desired throughput of oil sand.

The speed of rotation of the drum (20) should be chosen to provide a desired residence time in the separator (12). It has been found that a minimum residence time of about 5 minutes is necessary to provide adequate time for liberation and separation of bitumen from the oil sand, and it has also been found that a residence time exceeding 20 minutes does not significantly increase the recovery rate of bitumen. Although the residence time may be increased to up to about 60 minutes before deconsolidation of clay in the fine material occurs, the maximum residence time should in practice be limited by economic considerations, and should therefore be limited to between 5 and 20 minutes. Once the desired residence time is chosen, the speed of rotation of the drum (20) may be calculated by dividing the length of each flight of the spiral ribbon (18) by the residence time to determine the required peripheral velocity of the drum (20).

Once the speed of the drum (20) is chosen, the desired angle of the lifters (24) can be determined by considering the composition of the oil sand feedstock. Oil sand that has a high fine material content or which has a fine material content that is particularly susceptible to dispersal may require a more gentle degree of conditioning, with the result that the angle of the lifters (24) relative to the drum (20) may require adjustment. It has been found during testing that the highest degree of conditioning is obtained when the lifters (24) are adjusted at an angle of about +15° relative to a line normal to the interior surface of the drum (20), where positive angles are measured as being in the same direction, relative to this normal line, as the drum (20) rotates and where negative angles are measured as being in the opposite direction, relative to this normal line, as the direction of drum (20) rotation. The degree of conditioning becomes progressively less as the angle of the lifters (24) is moved from +15° to −60°, with −60° being the maximum negative angle that has been utilized. Degree of conditioning may also be decreased by moving the lifters (24) from +15° to +60° or more, but it has been found that angles of greater than +15° increase the amount of wear of the drum (20) and lifters (24), and should therefore be avoided. The appropriate angle of the lifters (24) can be determined by trial and error by performing test runs using a particular oil sand feedstock.

The desired temperature of the warm water entering the separator (12) will depend upon the temperature of the oil sand being fed into the separator (12), and upon the desired throughput of oil sand. In other words, the initial temperature of the warm water as it is fed into the separator (12) is a function of the heat transfer requirements of the oil sand. Testing has shown that liberation and separation of bitumen can be efficiently accomplished by thermal action by heating the oil sand to as low as 40° Celsius. However, at this temperature, the bitumen that is liberated and separated presents material handling problems, since it is still quite viscous. As a result, the temperature of the warm water fed into the separator (12) should be chosen, along with the ratio by weight of warm water to oil sand fed into the separator (12) so that the warm water exiting the separator (12) following the conditioning step has a temperature of at least 40° Celsius. Although there does not appear to be any upward limit, the temperature of the warm water entering the separator (12) should be kept as low as possible, since it will be contacted immediately with solid material preparing to exit the separator (12), with the result that a large amount of heat may be lost to this solid material if the temperature gradient is too high. Furthermore, the use of a lower process temperature decreases the input of thermal energy to the process. Consequently, the optimum temperature for the warm water exiting the separator (12) has been found to be about 50° Celsius, although the normal operating range is between about 40° Celsius and 60° Celsius. Testing has shown that this desired normal operating range of temperature for warm water exiting the separator (12) can normally be achieved if the warm water fed to the separator (12) has a temperature of between about 50° Celsius and 75° Celsius.

The warm water that is fed into the separator (12) forms a bath within the separator (12). The ratio by weight of warm water to oil sand fed into the separator (12), or in other words, the ratio by weight of warm water to oil sand in the bath is a function primarily of the amount of fine material contained within the oil sand feedstock and the propensity of that fine material to disperse during gentle conditioning. The concentration of dispersed fine material in the warm water following the conditioning step must be low enough that the separation of bitumen from the warm water is not significantly interfered with. Testing has shown that if the concentration of dispersed fine material in the warm water exceeds about 15% of the total weight of the warm water containing bitumen and dispersed fine material, the recovery of bitumen using the method begins to be compromised. As a result, the amount of warm water fed into the separator (12) should be such that the concentration of dispersed fine material in the warm water following the conditioning step is no greater than about 15% of the total weight of the warm water containing bitumen and dispersed fine material. For oil sand extracted from the Athabasca area with fine material content ranging from between about 3% to 30%, the required minimum ratio by weight of warm water to oil sand in the bath has been found to be between about 0.65 and 1.10. The amount of warm water required for a particular oil sand deposit may need to be increased from these minimum ratios in order to address a secondary consideration, that of providing sufficient warm water to effect adequate heat transfer to the oil sand during the conditioning step. For example, if the oil sand is frozen, more warm water may be necessary in order to ensure that for a desired residence time in the separator (12), the bitumen will be heated to the desired temperature when it exits the separator (12). Although the lower limit of warm water in the bath is dictated by the fine material content and the heat transfer requirements of the oil sand, there does not appear to be either an optimum ratio or an upper limit ratio of warm water to oil sand. However, in order to minimize the input of thermal energy into the process, it is desirable to limit the amount of warm water utilized as much as possible.

As previously indicated, the conventional hot water process for bitumen extraction makes use of sodium hydroxide (caustic) or similar reagents as a means for maintaining the pH of the process water at between about 8.0 and 8.5, which promotes the separation of bitumen from the process water at least in part by reducing the viscosity of the process water. This reduction in viscosity is accomplished by the chemical dispersal of fine material in the process water so that the particles of fine material are reduced in size even further than they are by the vigorous agitation of the oil sand during the conditioning step of the hot water process. It is the combination of the complete physical dispersal of most fine material contained in the oil sand, coupled with the further chemical dispersal by the caustic that generates the large amounts of unmanageable sludge that must be deposited in tailing ponds. This raises two important considerations relating to the conditioning step of the present invention.

First, the nature of the mechanical action imparted to the oil sand during the conditioning step by the rotating drum (20) and associated spiral ribbon (18) and lifters (24) should be as much as possible a gentle rolling action as opposed to a shaking or agitation of the lumps of oil sand. The extent of the rolling action required may vary according to the particular oil sand being processed, and can be adjusted by adjusting the angle of the lifters (24). The sole function of the mechanical action is to provide adequate contact between the lumps of oil sand and the warm water so that the liberation and separation of the bitumen is accomplished essentially by thermal action. For this reason, the separator (12) is designed so that the lumps of oil sand will be maintained beneath the surface of the bath as they travel through the separator (12) so that maximum contact between the warm water and the oil sand is achieved. By relying exclusively upon thermal action to liberate and separate the bitumen, it has been found that the physical dispersal of fine material is minimized.

Second, the chemistry of the warm water in the present invention should be controlled so that further chemical dispersal of the fine material that is physically dispersed does not occur. This is accomplished by not adding caustic to the warm water at any point in the process, and by regulating the concentration of bicarbonate ions in the warm water. It has been found that bicarbonate ions are largely responsible for chemical dispersal of fine material, and that bicarbonate ions tend to go into solution when the pH of the warm water is above about 7.0. When the pH of the warm water is below about 7.0, bicarbonate ions tend to react to form $CO_2$ and are therefore removed from solution. Testing has shown that the maximum permissible concentration of bicarbonate ions in the warm water to avoid significant chemical dispersal of fine material is about 6 Meq/litre. Consequently, the bicarbonate ion concentration in the warm water is controlled by adding an acid such as concentrated sulphuric acid to the warm water to adjust downwards the pH of the warm water to at least 7.0 so that new bicarbonate ions cannot go into solution. If the initial bicarbonate ion concentration is higher than the upper limit, then more acid may be required to create an environment where bicarbonate ions are removed from solution so that their concentration is less than about 6 Meq/litre. Although there is no minimum level of pH or bicarbonate ion concentration that is necessary for this invention, the addition of acid to the warm water should be made sparingly to minimize the cost and to prevent negative environmental effects of the acid treatment.

During the conditioning step, the lumps of oil sand are fed to one end of the separator (12) and moved towards the other end of the separator (12) by the flights of the spiral ribbon (18), while being rolled along the bottom of the drum (20) and lifted by the lifters (24). While they are being rolled through the drum (20), the lumps are being contacted by the warm water which is travelling in the opposite direction, which heats the oil sand and liberates and separates bitumen from it. By using the countercurrent separator (12), the oil sand is contacted first with warm water just before it exits the separator (12) through the warm water discharge opening (26), and is only contacted by higher temperature warm water which has just entered the separator (12) just before the solid material is removed from the separator (12). This has the effect of contacting the bitumen that is most difficult to liberate with the highest temperature warm water, which assists in enhancing the bitumen recovery rate. As the lumps are rolled through the drum (20) and are heated by the warm water, the bitumen in the oil sand becomes liberated from the solid material in the oil sand and agglomerates into droplets. Upon this liberation, the bitumen becomes separated from the solid material and the solid material sinks to the bottom of the drum (20) and the bitumen, having gas or air entrained within it, tends to float on or in the warm water as a froth. The small amount of fine material that becomes dispersed during the conditioning step also becomes suspended in the warm water as it flows towards the warm water discharge opening (26).

Following the conditioning step, the next steps in the method are the removal from the bath of the solid material and of the warm water containing bitumen and dispersed fine material and their collection for further processing.

The removal from the bath of the solid material is accomplished by providing a number of draining pockets (28) around the circumference of the interior of the drum (20) at the end of the spiral ribbon (18) and adjacent the solid material discharge opening (27). The solid material is collected in the draining pockets (28) and is lifted above the surface of the bath as the drum (20) rotates, draining the solid material of excess water. As the draining pockets (28) are rotated with the drum (20), the solid material contained within them falls out by gravity, through the solid material discharge opening (27) into a hopper (32) and then to a conveyor (34), by which the solid material is moved to a mixing drum (36) for further processing.

The removal from the bath of the warm water containing bitumen and dispersed fine material is accomplished after the warm water passes through the settling zone (30) and occurs as the warm water exits the separator (12) via the warm water discharge opening (26) and enters a collection launder (38). From the collection launder (38), the warm water flows by a line (40) to a pump (42), by which the warm water is pumped to a froth separator vessel (44) so that the next step, that of separating the warm water into bitumen froth and a suspension of dispersed fine material, can begin.

In the froth separator (44), bitumen in the warm water which is sufficiently aerated by gas inclusions or entrained air floats to the top of the froth separator (44) and is collected and removed for storage via a line (46) as bitumen froth which will typically contain between about 50% and 90% by weight of the total amount of bitumen recovered from the oil sand and which will typically have a concentration by weight of between 50% and 70% bitumen.

The underflow from the froth separator (44) may contain significant amounts of residual bitumen, depending upon the amount of dispersed fine material in the warm water and upon the degree of aeration of the bitumen as it leaves the separator (12). As a result, the froth separator underflow is removed from the separator (44) through a line (48) and is then pumped by a pump (50) to a froth flotation cell (52) where is undergoes a froth flotation treatment to aerate further the residual bitumen contained in the warm water. Following the froth flotation treatment, the froth at the top of froth flotation cell (52) is transported by a line (54) to a froth cleaner vessel (56) which operates in similar fashion as the separator (44), whereby the aerated residual bitumen contained in the froth floats to the top of the froth cleaner (56) as bitumen froth, which is then collected and removed for storage with the bitumen froth recovered from the separator (44) via a line (58). The bitumen froth recovered from the froth cleaner (56) will typically contain between about 10% and 50% of the total amount of bitumen recovered from the oil sand and will typically have a concentration by weight of between about 30% and 60% bitumen. The underflow from the froth cleaner (56) is removed from the froth cleaner (56) via a line (60) to a pump (62) where it is pumped through a line (64) back to the froth flotation cell (52) for further froth flotation treatment.

The underflow from the froth flotation cell (52) will contain small amounts of bitumen, but will essentially comprise a suspension of dispersed fine material. The next step in the method is the dewatering of this suspension of dispersed fine material, and is accomplished by removing the underflow from the froth flotation cell (52) via a line (66) to a pump (68), where it is pumped through a line (70) to a solids thickener (72), where the suspension of dispersed fine material is converted to a sludge by a combination of the effects of gravity and the action of a flocculant.

Due to the relatively small amounts of fine material that become dispersed in the warm water during the conditioning step, it has been found that the dimensions of the thickener (72) can be kept to a manageable size. Testing has shown that the thickening area required for the thickener (72) is between about 0.2 and 0.8 square metres per tonne per day of dispersed fine material contained in the warm water entering the thickener (72). As mentioned before, the conditioning step is designed so that the concentration of dispersed fine material contained in the warm water leaving the separator (12) will be less than about 15% of the total weight of the warm water containing bitumen and dispersed fine material. By considering the fine material content of the oil sand to be processed and the desired throughput of oil sand to be processed by the method, the appropriate size of the thickener (72) can be calculated.

Testing has also shown that since the fine material dispersed in the warm water entering the thickener (72) has not been subjected to chemical dispersal, the sludge produced by the thickener (72) can be concentrated to between about 30% to 60% solids by total weight of sludge after less than about three hours in the thickener (72). In fact, a fine material concentration in the sludge of up to 30% may be achieved by as little as 30 minutes in the thickener (72). It is estimated that the combination of the reduced amount of fine material that is dispersed by this method and the improved settling characteristics in the thickener (72) of the non-chemically dispersed suspension translates to a reduction in the volume of sludge generated by this method in comparison with the conventional hot water process by approximately 75%. In other words, this method appears to generate only about ¼ as much sludge as does the conventional hot water process, since the sludge that is disposed of in the tailing ponds typically contains less than about 25% solids, and much more fine material is dispersed by the hot water process than by this method.

One of the objectives of this method, however, is the recycling of as much process water as is possible so that the amount of makeup water required is minimized. This recycling is accomplished by reheating and returning to the separator (12) the clarified warm water that is recovered from the top of the thickener (72). It has been found that the preferred maximum concentration of fine material in the recycled warm water is about 2% by total weight of warm water recycled. As a result of the settling characteristics of the non-chemically dispersed fine material contained in the warm water, it has been found that the warm water entering the thickener (72) is of sufficient clarity to be recycled in less than about 12 hours, with the range of the minimum residence time of the warm water in the thickener (72) appearing to be between about 6 hours and 12 hours in order to achieve the preferred concentration of fine material in the warm water to be recycled. Advantageously, the preferred minimum time for clarification of the warm water in the thickener (72) provides additional time for the settlement and concentration of fine material in the sludge.

Once the warm water in the thickener (72) is of sufficient clarity to be recycled, it is removed from the thickener (72) via a thickener overflow line (74) and transported to the water heater (16) where the required amount of makeup water is added to the recycled warm water by a line (76) after being passed by a pump (78) from a makeup water storage vessel (80). The recycled warm water is then returned, together with the necessary makeup water, to the separator (12) by being pumped by a pump (82) through the warm water line (14). Testing has shown that the amount of makeup water that must be added to the recycled warm water is typically between about 12% and 20% by weight of the throughput of oil sand being processed by this method. The makeup water is added intermittently as required in order to supplement the warm water recovered from the thickener (72).

Settlement of the dispersed fine material in the thickener (72) is promoted by the addition of a flocculant to the suspension of dispersed fine material. This flocculant is added to the suspension by way of a flocculant line (84) which is upstream of the thickener (72), thus allowing the suspension and the flocculant to mix thoroughly before reaching the thickener. The flocculant that has been used most extensively during testing is Superfloc (™) 1206 Plus Flocculant, an anionic polyacrylamide in water-in-oil emulsion manufactured by American Cyanamid Company, but may be any other flocculant that is known in the art for the purpose of promoting the flocculation and settlement of similar sludges. The desired amount of Superfloc (™) 1206 Plus Flocculant to be added to the suspension has been found during testing to be between about 10 grams and 80 grams per tonne of throughput of oil sand being processed. If too little flocculant is used, adequate thickening of the sludge may take longer than the desired 6 hours to 12 hours. If too much flocculant is used, large, loose flocs tend to be generated, which do not thicken in ideal fashion. Different amounts of flocculant may be required if a different flocculant is used.

As mentioned before, one of the important considerations in the method is that the chemistry of the warm water must be controlled to maintain the bicarbonate ion concentration below about 6 Meq/litre. Control of the chemistry of the warm water is accomplished by sampling the warm water contained in the thickener (72) and by adding sulphuric acid to the thickener by a line (86) if the bicarbonate ion concentration in the warm water or the pH of the warm water is too high. It has been found that typically, between about 5 grams and 20 grams of concentrated sulphuric acid per tonne of throughput of oil sand being processed is required to be added to the thickener (72). Due to the relatively small amount of makeup water that is added to the recycled warm water, and due to the typically neutral chemistry of the makeup water, the makeup water is not normally sampled for bicarbonate ion concentration or pH. Sampling of the warm water to be fed to the separator (12) could, however, take place at any point before the separator (12), such as for example in the warm water heater (16) or in the warm water line (14).

Once the suspension of dispersed fine material has been dewatered in the thickener (72), the last step in the method is that of combining the solid material and the sludge to produce the nonsegregating tailings. The sludge produced in the thickener (72) is withdrawn from the thickener (72) by a line (88) and is pumped by a pump (90) through a sludge line (92) to the mixing drum (36).

Figure 4:
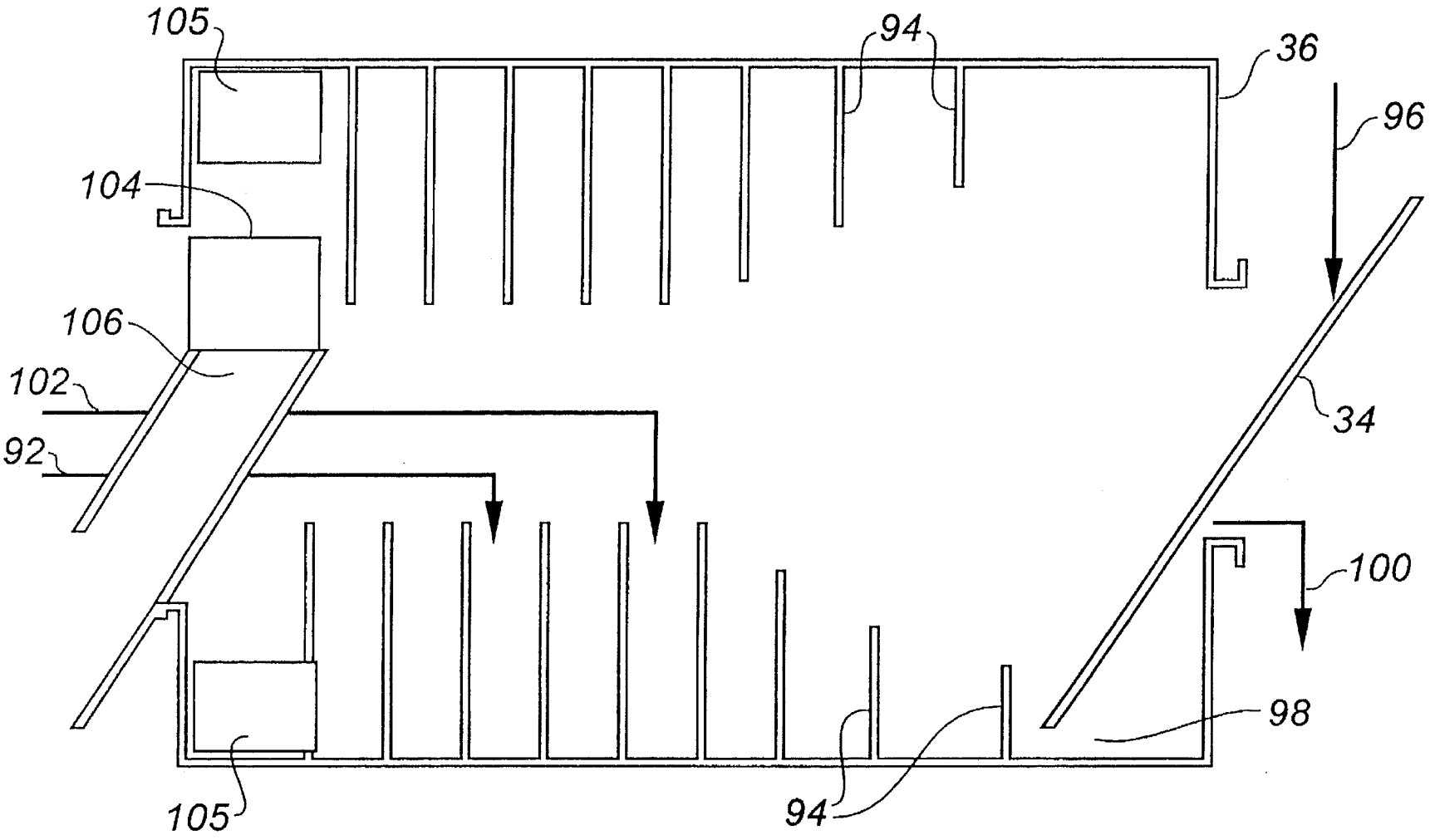
FIG. 4 is a schematic drawing of a mixing drum according to the preferred embodiment of this invention.

Referring to FIG. 4, the mixing drum (36) includes a spiral ribbon (94). The spiral ribbon (94) may be supported in the mixing drum (36) so that it rotates while the mixing drum (36) remains stationary, but in the preferred embodiment, the mixing drum (36) is designed so that the spiral ribbon (94) is fixed to the mixing drum (36) so that the mixing drum (36) and the spiral ribbon (94) rotate together. Other forms of mixing apparatus known to persons skilled in the art may also be used in place of the mixing drum (36). The solid material enters the mixing drum (36) via the conveyor (34), where it is mixed with a small amount of warm water that is supplied by a line (96) to the conveyor (34). The line (96) is in turn supplied by the warm water line (14), so that the warm water mixed with the solid material is heated to between 50° Celsius and 75° Celsius. The warm water supplied by the line (96) to the solid material is typically added in an amount such that the ratio by weight of warm flushing water to throughput of oil sand being processed is between about 0.05 and 0.10, and acts as a flushing agent which makes the solid material easier to handle and assists the solid material in settling to the bottom of the mixing drum (36), where it is collected in a settling compartment (98) and then taken up by the spiral ribbon (94). The spiral ribbon (94) compresses and dewaters the solid material and moves it through the mixing drum (36). Portions of the flushing water and the water contained in the solid material, and some residual bitumen that becomes liberated and separated from the solid material due to the addition of the flushing water are withdrawn from the mixing drum (36) by a line (100) and sent to the pump (42) where they are transported to the froth separator (44) for recovery of some of the residual bitumen.

A flocculant line (102) adds a flocculant to the solid material partway along the mixing drum (36). The flocculant most extensively used during testing has been Superfloc (™) 1206 Plus Flocculant, and is preferably added in an amount of between about 10 grams and 50 grams per tonne of solid material (36) in order to achieve the best results during the filtering which follows. However, any flocculant known in the art for the flocculation of sludges similar to the sludge being conveyed by the sludge line (92) could be utilized, and the amount of flocculant added may be varied to take into consideration the characteristics of different flocculants. Following the addition of this flocculant, the solid material is permitted to mix with the flocculant for several revolutions of the spiral ribbon (94) to provide a substantially uniform distribution of flocculant throughout the solid material. The sludge is then added to the mixing drum (36) via the sludge line (92) and the mixture of the solid material, flocculant and sludge is permitted to mix for several revolutions of the spiral ribbon (94) so that the mixture is substantially uniform before the end of the mixing drum (36) is reached. The mixture is then discharged from the mixing drum (36) through a discharge opening (104) by lifting pockets (105) to a conveyor (106) and then to a vacuum belt filter (108).

The vacuum belt filter (108) is a conventional vacuum belt filter comprising a perforated belt which is covered with a filter media. The mixture of solid material, flocculant and sludge is deposited on the covered belt and a vacuum is drawn from underneath to remove water or moisture from the mixture. This water is collected in a line (110) and is pumped by a pump (112) through a line (114) back to the froth flotation cell (52), where it undergoes further froth flotation treatment. The filter covering the belt is rinsed from the underside of the vacuum belt filter (108) with warm water from the water heater (16) to remove any bitumen which may adhere to the filter and thus interfere with the filtering of the mixture. The dewatered mixture of solid material, flocculant and sludge comprises nonsegregating tailings of solid material and sludge and is passed from the vacuum belt filter (108) to a conveyor (116) by which the tailings are transported for storage or disposal.

The step of combining the solid material and the sludge to produce the nonsegregating tailings as outlined above using the mixing drum (36), the vacuum belt filter (108), and a flocculant is believed to work due to the coating of the solid material by the flocculant, which then acts as a nucleus for the flocculation of the dispersed fine material contained in the sludge. It is for this reason that in the preferred embodiment, the solid material is mixed first with the flocculant, and then the solid material and the flocculant are mixed with the sludge. It may, however, be possible to mix the solid material, flocculant and sludge together at the same time in a manner as outlined in U.S. Pat. No. 4,225,433.

It has also been found that if the combined moisture content of the solid material and the sludge is too low, the mixture of solid material, flocculant and sludge is difficult to filter, and it is believed that this phenomenon is due to the mixture having a permeability which is so great that it is difficult for the vacuum belt filter (108) to maintain a vacuum during filtering of the mixture. This phenomenon can be observed visually by the mixture exhibiting an uneven texture as it passes along the vacuum belt filter (108), indicating that filtration is not occurring thoroughly and efficiently. As a general guideline, if the fine material concentration of the sludge is greater than about 40% by weight of sludge, it may be necessary to add water to the mixture in the mixing drum (36) in order to increase the moisture content of the mixture and thus improve the efficiency of the vacuum belt filter (108). The amount of water required to be added will depend upon the extent of the moisture deficiency in the mixture and upon the relative proportions of solid material and sludge forming the mixture. A similar phenomenon has been observed during testing when excessive amounts of flocculant are utilized. Consequently, for best results during the vacuum filtering of the mixture, it may be necessary both to increase the moisture content of the mixture by the addition of water in the mixing drum (36), and to reduce the amount of flocculant that is fed to the mixing drum (36) by the flocculant line (102).

The nonsegregating tailings of solid material and sludge produced by this method exhibit good engineering properties for use as backfill material, in that they do not segregate over time, and are trafficable so long as the fine material content of the oil sand feedstock is not greater than about 25% by weight of total mineral matter present in the oil sand. Even as the fine material content approaches 30%, the tailings continue to be usable as backfill, even if they are not capable of sustaining vehicular traffic, and continue to be nonsegregating. Typically, the tailings have a moisture content leaving the vacuum belt filter (108) of between about 12% and 20% by total weight of tailings, and essentially the only loss of process water that occurs during the method is due to the moisture content of the tailings and the small amount of the warm water that is lost as part of the bitumen froth.

Testing has shown that the solid material and the sludge may also be combined to produce the nonsegregating tailings without the use of a flocculant. This method for producing the tailings comprises first, dewatering the solid material by filtering the solid material obtained from the conveyor (34) using the vacuum belt filter (108), and then mixing the dewatered solid material with the sludge obtained from the sludge line (92) in the mixing drum (36) until the mixture of solid material and sludge is substantially uniform and therefore constitutes the nonsegregating tailings. The tailings are then transported by the conveyor (116) for storage or disposal. Nonsegregating tailings produced by mixing dewatered solid material and sludge have exhibited similar engineering properties to those produced with the use of flocculants, and typically also have a moisture content following the mixing of the dewatered solid material and sludge of between 12% and 20% by total weight of tailings. However, for an equivalent mix of solid material and sludge, it is believed that the tailings produced using a flocculant will have a moisture content slightly lower than those produced by combining dewatered solid material and sludge, perhaps by about 2% to 3%.

Preliminary testing to compare the tailings produced by the two methods has suggested that the angle of repose of the tailings is greater if flocculant is used to produce them, and that the angle of repose increases with the amount of flocculant that is used. Predictably, the angle of repose for tailings produced using either of the two methods tends to decrease as the fine material content of the tailings increases.

The method as practised according to the preferred embodiment typically provides for bitumen recovery in the range of between about 80% and 95%. Recoveries approaching the lower end of this range may be experienced where the oil sand feedstock has both a relatively high fine material content and a relatively low bitumen content. Recoveries approaching the higher end of the range are experienced where the oil sand feedstock has both a relatively low fine material content and a relatively high bitumen content. It is possible that the recovery of bitumen using this method could be enhanced by further treatment of the various process streams throughout the different steps of the method, since the recycled warm water, the solid material and the sludge all contain small residual amounts of bitumen which may be recoverable by such further treatment. However, the economic feasibility of further treatment of these process streams has not yet been determined.

Finally, although this invention is described as a method for processing oil sand, the method may also be applicable to the processing of other types of material which contain bitumen or other viscous hydrocarbons such as heavy oil, and this specification should not be construed as being intended to exclude the use of the method on such materials that are not oil sand, but exhibit properties similar to those of oil sand.

A further embodiment of the invention comprises the production of nonsegregating tailings from solid material containing an amount of water and a sludge of dispersed fine material. The further embodiment comprises the method for producing tailings with the use of a flocculant as outlined above in the preferred embodiment, and the same apparatus and flocculants as in the preferred embodiment may be used in the further embodiment.

The further embodiment may be utilized in various situations where it is desirable to combine two distinct streams of tailings, one containing solid material as defined in this disclosure, and one containing fine material as defined in this disclosure. It is best suited, however, to situations where the fine material contained in the sludge has not been chemically dispersed, due to the problems associated with consolidating sludges where chemical dispersal of the fine material has occurred, and to situations where the combined fine material content of the solid material and the sludge is not greater than about 30% by total weight of mineral matter, due to the reduction in desirable engineering properties that occurs as the fine material content of the tailings increases.

As a result, the further embodiment is ideal for use in processing tailings that are generated by processes that minimize the dispersal of fine material, and where the chemistry of the process water has been controlled to minimize or eliminate further chemical dispersal of physically dispersed fine material. However, it is believed that even where some chemical dispersal of fine material has occurred, nonsegregating tailings can be produced using the method of the further embodiment by first decarbonating the solid material and the sludge by the addition of an acid to them so that the concentration of bicarbonate ions can be reduced to less than 6 Meq/litre and an environment can be created that discourages the production of new bicarbonate ions in solution. By first decarbonating the solid material and the sludge in this manner, it is believed that even tailings generated from the conventional hot water process could be converted to nonsegregating tailings using the method of the further embodiment.

The embodiments of the invention in which an exclusive property or privilege is claimed are defined as follows:

1. A method for processing lumps of oil sand containing bitumen to produce a bitumen froth and nonsegregating tailings of a solid material and a sludge, comprising:

(a) depositing the lumps into a bath of warm water at a temperature of between about 40° Celsius and about 75° Celsius;

(b) conditioning the lumps of oil sand in the absence of added caustic by gently rolling the lumps in the bath to contact the lumps with the warm water to liberate and separate bitumen from the oil sand while minimizing the dispersal into the bath of fine material contained in the oil sand;

(c) removing from the bath and collecting for further processing the solid material remaining after the liberation and separation of the bitumen from the oil sand;

(d) removing from the bath and collecting for further processing the warm water containing bitumen and dispersed fine material;

(e) separating the warm water containing bitumen and dispersed fine material into the bitumen froth and a suspension of dispersed fine material;

(f) dewatering the suspension of dispersed fine material to produce the sludge; and (g) combining the solid material and the sludge to produce the tailings.

2. The method as claimed in claim 1, further comprising the step of breaking the oil sand into the lumps prior to the step of depositing the lumps in the bath of warm water, and wherein the lumps are of a size that will not jam process machinery.

3. The method as claimed in claim 1, further comprising containing the bath in a cylindrical drum and then gently rolling the lumps through the drum by a spiral ribbon and lifters associated with the drum.

4. The method as claimed in claim 1, wherein the lumps are maintained beneath the surface of the bath while being gently rolled in the bath in order to maximize the contact between the lumps and the warm water.

5. The method as claimed in claim 1, wherein the ratio by weight of warm water to oil sand in the bath is between about 0.65 and 1.10.

6. The method as claimed in claim 1, wherein the ratio by weight of warm water to oil sand in the bath is chosen so that the concentration of dispersed fine material in the warm water following the step of conditioning the lumps of oil sand is less than about 15% by weight of the warm water containing bitumen and dispersed fine material.

7. The method as claimed in claim 1, further comprising the step of allowing solid material to settle after conditioning the lumps of oil sand but before removing the solid material from the bath.

8. The method as claimed in claim 1, wherein the temperature of the warm water following the step of conditioning the lumps of oil sand is between about 40° Celsius and 60° Celsius.

9. The method as claimed in claim 8, wherein the step of conditioning the lumps of oil sand is performed for between about 5 and 60 minutes.

10. The method as claimed in claim 1, wherein the temperature of the warm water following the step of conditioning the lumps of oil sand is about 50° Celsius.

11. The method as claimed in claim 10, wherein the step of conditioning the lumps of oil sand is performed for between about 5 and 60 minutes.

12. The method as claimed in claim 1, wherein the temperature of the warm water at the beginning of the step of conditioning the lumps of oil sand is between about 50° Celsius and 75° Celsius.

13. The method as claimed in claim 1, wherein the warm water is moving relative to the lumps of oil sand during the step of conditioning the lumps.

14. The method as claimed in claim 13, wherein the warm water is moving in the opposite direction as the lumps of oil sand during the step of conditioning the lumps.

15. The method as claimed in claim 1, wherein the step of conditioning the lumps of oil sand comprises gently rolling the lumps within the warm water, wherein the warm water is moving in the opposite direction as the lumps during the step of conditioning the lumps, wherein the solid material is removed from one end of the bath and the warm water containing bitumen and dispersed fine material is removed from the other end of the bath, and wherein the solid material and the warm water are supplied to the bath at the opposite ends of the bath from which they are removed.

16. The method as claimed in claim 1, wherein the step of separating the warm water containing bitumen and dispersed fine material into the bitumen froth and a suspension of dispersed fine material comprises floating the bitumen on the surface of the warm water and then removing the bitumen from the surface of the warm water as bitumen froth.

17. The method as claimed in claim 1, wherein the step of separating the warm water containing bitumen and dispersed fine material into the bitumen froth and a suspension of dispersed fine material comprises the steps of:

(a) placing the warm water containing bitumen and dispersed fine material into a first separator vessel to permit bitumen having air entrained within it to rise to the surface of the warm water;

(b) skimming the air entrained bitumen from the surface of the warm water and collecting it as bitumen froth;

(c) subjecting the remaining warm water containing bitumen and dispersed fine material to froth flotation to produce a froth containing bitumen and a suspension of dispersed fine material;

(d) placing the froth containing bitumen into a second separator vessel to permit bitumen to rise to the surface of the froth; and (e) skimming the bitumen from the surface of the froth and collecting it as bitumen froth.

18. The method as claimed in claim 17, further comprising the step of combining the froth remaining after step (e) with the warm water remaining after step (b) and thereby re-subjecting the remaining froth to steps (c), (d) and (e).

19. The method as claimed in claim 1, further comprising the step of maintaining the concentration of bicarbonate ions in the warm water at less than about 6 Meq/litre.

20. The method as claimed in claim 19, wherein the concentration of bicarbonate ions in the warm water is maintained at less than about 6 Meq/litre by adding an acid to the warm water.

21. The method as claimed in claim 1, wherein the step of dewatering the suspension of dispersed fine material comprises mixing a flocculant with the suspension to promote the aggregation and settlement of dispersed fine material contained in the suspension, and then allowing the fine material to settle to produce the sludge.

22. The method as claimed in claim 1, wherein the step of dewatering the suspension of dispersed fine material is performed within a period of less than about 12 hours.

23. The method as claimed in claim 1, further comprising the step of dewatering the solid material prior to combining it with the sludge.

24. The method as claimed in claim 23, wherein the step of dewatering the solid material comprises filtering the solid material.

25. The method as claimed in claim 24, wherein the step of filtering the solid material comprises spreading the solid material on a moving belt filter and then exposing the solid material to a vacuum to withdraw moisture from the solid material.

26. The method as claimed in claim 23, wherein the tailings produced have a moisture content of between about 12% and 20% by total weight of tailings.

27. The method as claimed in claim 26, wherein for a given quantity of oil sand processed, the tailings are produced using substantially all of the solid material and substantially all of the sludge that is generated from the oil sand.

28. The method as claimed in claim 23, further comprising the step of reheating and returning to the bath the warm water recovered during the step of dewatering the suspension of dispersed fine material and the step of dewatering the solid material.

29. The method as claimed in claim 23, further comprising the steps of adding the warm water recovered during the step of dewatering the solid material to the warm water containing bitumen and dispersed fine material and then reheating and returning to the bath the warm water recovered during the step of dewatering the suspension of dispersed fine material.

30. The method as claimed in claim 1, wherein the step of combining the solid material and the sludge comprises the steps of:

(a) mixing the solid material with an amount of a flocculant;

(b) mixing the solid material and the flocculant with the sludge; and (c) dewatering the mixture of the solid material, flocculant, and the sludge to produce the tailings;

wherein the amount of flocculant mixed with the solid material is a finite amount which is sufficient to cause flocculation of the dispersed fine material in the sludge with the solid material but which is less than an amount which will significantly impair the dewatering step.

31. The method as claimed in claim 30, wherein the solid material is mixed with the flocculant before being mixed with the sludge.

32. The method as claimed in claim 30, wherein the step of dewatering the mixture of solid material, flocculant and sludge comprises filtering the mixture.

33. The method as claimed in claim 32, wherein the step of filtering the mixture comprises spreading the mixture on a moving belt filter and then exposing the mixture to a vacuum to withdraw moisture from the mixture.

34. The method as claimed in claim 30, wherein the tailings produced have a moisture content of between about 12% and 20% by total weight of tailings.

35. The method as claimed in claim 34, wherein for a given quantity of oil sand processed, the tailings are produced using substantially all of the solid material and substantially all of the sludge that is generated from the oil sand.

36. The method as claimed in claim 30, further comprising the step of reheating and returning to the bath the warm water recovered during the step of dewatering the suspension of dispersed fine material and the step of dewatering the mixture of solid material, flocculant and sludge.

37. The method as claimed in claim 30, further comprising the step of adding the warm water recovered during the step of dewatering the mixture of solid material, flocculant and sludge to the warm water containing bitumen and dispersed fine material and then reheating and returning to the bath the warm water recovered during the step of dewatering the suspension of dispersed fine material.

38. The method as claimed in claim 1, wherein between about 80% and 95% of the bitumen contained in the oil sand is recovered as bitumen froth.

39. The method as claimed in claim 1, wherein the oil sand has a fine mineral matter content of less than about 30% by total weight of mineral matter contained in the oil sand.

* * * * *

UNITED STATES PATENT AND TRADEMARK OFFICE

CERTIFICATE OF CORRECTION

PATENT NO. : 5,645,714
DATED : July 8 , 1997
INVENTOR(S) : Strand et al

It is certified that error appears in the above-indentified patent and that said Letters Patent is hereby corrected as shown below:

In the cover page, Assignee Name, change "Bitman" to --Bitmin--.

In Column 12, line 25, change "Celsius," to --Celsius.--

In Column 17, line 52, change "material (36)" to --material fed through the mixing drum (36)--

In Column 17, line 58, change "this" to --the--

In Column 14, line 67, change "is" to --it--

Signed and Sealed this

Twenty-second Day of September, 1998

*Attest:*

Bruce Lehman

BRUCE LEHMAN

*Attesting Officer*

*Commissioner of Patents and Trademarks*